US011819134B2

(12) United States Patent
Kappenman

(10) Patent No.: US 11,819,134 B2
(45) Date of Patent: Nov. 21, 2023

(54) MATTRESS

(71) Applicant: Bed Patent Holdings Limited Liability Company, Las Vegas, NV (US)

(72) Inventor: Kevin J. Kappenman, Huntington Beach, CA (US)

(73) Assignee: BED PATENT HOLDINGS LIMITED LIABILITY COMPANY, Las Vegas, NV (US)

( * ) Notice: Subject to any disclaimer, the term of this patent is extended or adjusted under 35 U.S.C. 154(b) by 151 days.

(21) Appl. No.: 17/347,196

(22) Filed: Jun. 14, 2021

(65) Prior Publication Data

US 2021/0337980 A1 Nov. 4, 2021

Related U.S. Application Data

(63) Continuation-in-part of application No. 17/244,353, filed on Apr. 29, 2021, now abandoned, and a continuation-in-part of application No. 17/243,154, filed on Apr. 28, 2021.

(60) Provisional application No. 63/018,253, filed on Apr. 30, 2020.

(51) Int. Cl.
*A47C 27/14* (2006.01)

(52) U.S. Cl.
CPC ..... *A47C 27/144* (2013.01); *A47C 27/148* (2013.01)

(58) Field of Classification Search
CPC ... A47C 27/144; A47C 27/148; A47C 27/064; A47C 27/20; A47C 27/065; A47C 27/063; A47C 27/07
See application file for complete search history.

(56) References Cited

U.S. PATENT DOCUMENTS 2,621,340 A * 12/1952 Mogridge ..... A47C 27/065 5/255
5,044,027 A * 9/1991 Moon ..... A47C 27/15 5/652
5,165,125 A * 11/1992 Callaway ..... A47C 23/002 5/255
6,170,808 B1 * 1/2001 Kutschi ..... A47C 27/146 5/247
6,343,394 B1 * 2/2002 Gandolfi ..... A47C 27/065 5/690
10,849,438 B1 * 12/2020 Schulman ..... A47C 27/148
2007/0044241 A1 * 3/2007 Clark ..... A47C 27/15 5/655.9
2010/0227091 A1 * 9/2010 Pearce ..... B32B 3/08 428/36.1

(Continued)

FOREIGN PATENT DOCUMENTS

CH 683234 A5 * 2/1994 ..... A47C 20/04
DE 10016934 A1 * 6/2001 ..... A47C 23/002

(Continued)

*Primary Examiner* — Justin C Mikowski
*Assistant Examiner* — Alison N Labarge
(74) *Attorney, Agent, or Firm* — Blue Capital Law Firm, P.C.

(57) ABSTRACT

A mattress includes a flex structure having at least one support layer and a plurality of marbles engaged with the at least one support layer and supported by the at least one support layer. The plurality of marbles is arranged in a grid pattern along the at least one support layer.

18 Claims, 10 Drawing Sheets

(56) References Cited

U.S. PATENT DOCUMENTS

| | | | | |
|---|---|---|---|---|
| 2011/0239372 | A1* | 10/2011 | Bhat | A61G 7/05738 5/655.4 |
| 2019/0216226 | A1* | 7/2019 | Theosabrata | A47C 27/084 |
| 2020/0237111 | A1* | 7/2020 | Micklos | A47C 27/20 |

FOREIGN PATENT DOCUMENTS

| | | | | |
|---|---|---|---|---|
| EP | 0263065 | A2 * | 9/1987 | A57C 27/20 |
| KR | 100870535 | B1 * | 11/2008 | |

* cited by examiner

MATTRESS

CROSS-REFERENCE TO RELATED APPLICATIONS

The present application is a continuation-in-part of U.S. application Ser. No. 17/243,154, filed on Apr. 28, 2021, and is a continuation-in-part of U.S. application Ser. No. 17/244,353, filed on Apr. 29, 2021, both of which claims the benefit of U.S. Provisional Patent Application Ser. No. 63/018,253, filed on Apr. 30, 2020, all of which are incorporated herein by reference.

TECHNICAL FIELD

The disclosure relates generally to a mattress, and more particularly to a mattress including a flex structure having a plurality of marbles and adapted to flex and temporarily deform according to a body profile of the person lying on the mattress.

BACKGROUND

Currently mattresses use coil springs, foam materials, inflatable air chambers or water filled chambers to support the person lying down on the mattress. Each of these methods has limitations that is overcome by the present disclosure.

SUMMARY

According to an aspect of the disclosure, a mattress is provided. The mattress includes a flex structure having at least one support layer and a plurality of marbles engaged with the at least one support layer and supported by the at least one support layer. The plurality of marbles is arranged in a grid pattern along the at least one support layer.

In one embodiment, the support layer includes a first surface and a second surface arranged opposite to the first surface and defines a plurality of holes extending from the first surface to the second surface and arranged in a plurality of rows. The plurality of marbles is arranged in the plurality of holes.

In one embodiment, each marble is a spherical marble and a diameter of each marble is equal to or less than a depth of the associated hole.

In one embodiment, the at least one support layer includes a first support layer and a second support layer arranged spaced apart and opposite to the first support layer. The plurality of marbles is arranged between the first support layer and the second support layer.

In one embodiment, the flex structure includes a connecting grid having a plurality of connecting elements connecting each marble with adjacently disposed marbles.

In one embodiment, the mattress further includes a support structure supporting the flex structure. The support structure includes a base layer having a first surface and a second surface arranged opposite to the first surface. The base layer defines a plurality of slots extending from the first surface to the second surface and arranged in a plurality of rows in a staggered arrangement. The support structure further includes a plurality of hoop assemblies arranged inside the plurality of the slots. Each hoop assembly includes a hoop arranged vertically inside the slot and a central axis of the hoop extends substantially horizontally and parallel to the first surface. The hoop is configured to compress under a load.

In one embodiment, the plurality of the rows is arrayed in a lateral direction between a first lateral end of the base layer and a second lateral end of the base layer, and the slots are arrayed in a longitudinal direction within each row.

In one embodiment, the plurality of rows includes a plurality of first rows and a plurality of second rows, where a single second row is arranged between two neighboring first rows. Each slot of the second row overlaps two slots of the adjacent first row.

In one embodiment, each hoop assembly includes a pouch defining a pocket, wherein the hoop is arranged inside the pocket and the pouch controls a deflection of hoop under the load.

In one embodiment, the pouch allows a loading of a portion of the hoop arranged proximate to the second surface of the base layer and contouring a portion of the hoop arranged proximate to the first surface of the base layer when a person lies on the mattress.

In one embodiment, the support structure further includes a fabric layer arranged on the base layer and abutting the first surface of the base layer to cover the plurality of hoop assemblies.

In one embodiment, the mattress further includes an alignment layer sandwiched between the support structure and the flex structure to facilitate an ergonomic alignment of a back or a lumber portion of a person when a person lies on the mattress.

In one embodiment, the alignment layer includes a first surface and a second surface arranged opposite to the first surface and disposed facing the first surface of the base layer. The alignment layer defines a plurality of first cut-outs extending from the first surface to the second surface and arranged in a plurality of rows in a staggered arrangement.

In one embodiment, the first cutouts are arranged between a first longitudinal end of the alignment layer and a second longitudinal end of the alignment layer such that the first cut-outs are arranged, at least partially, beneath a lower back and a hip portion of a person when the person lies on the mattress.

In one embodiment, each first cutout includes a diamond shape.

In one embodiment, the alignment layer includes a plurality of second cutouts extending from a first surface of the alignment layer to a second surface of the alignment layer. The plurality of second cutouts is arranged in a plurality of rows in a staggered arrangement.

In one embodiment, the second cut-outs are arranged between a first longitudinal end of the alignment layer and a second longitudinal end of the alignment layer such that the second cutouts are arranged, at least partially, beneath at least one of an upper back or a shoulder portion of the person when the person lies on the mattress.

In one embodiment, each second cutout includes a diamond shape.

In one embodiment, a density of the alignment layer is less than a density of the base layer.

For a more complete understanding of the present disclosure, reference is made to the following detailed description and accompanying drawings. In the drawing, like reference characters refer to like parts throughout the views in which:

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts. Also, wherever possible, the same reference numbers will be used throughout the drawings to refer to the same or the like parts.

Figure 1:
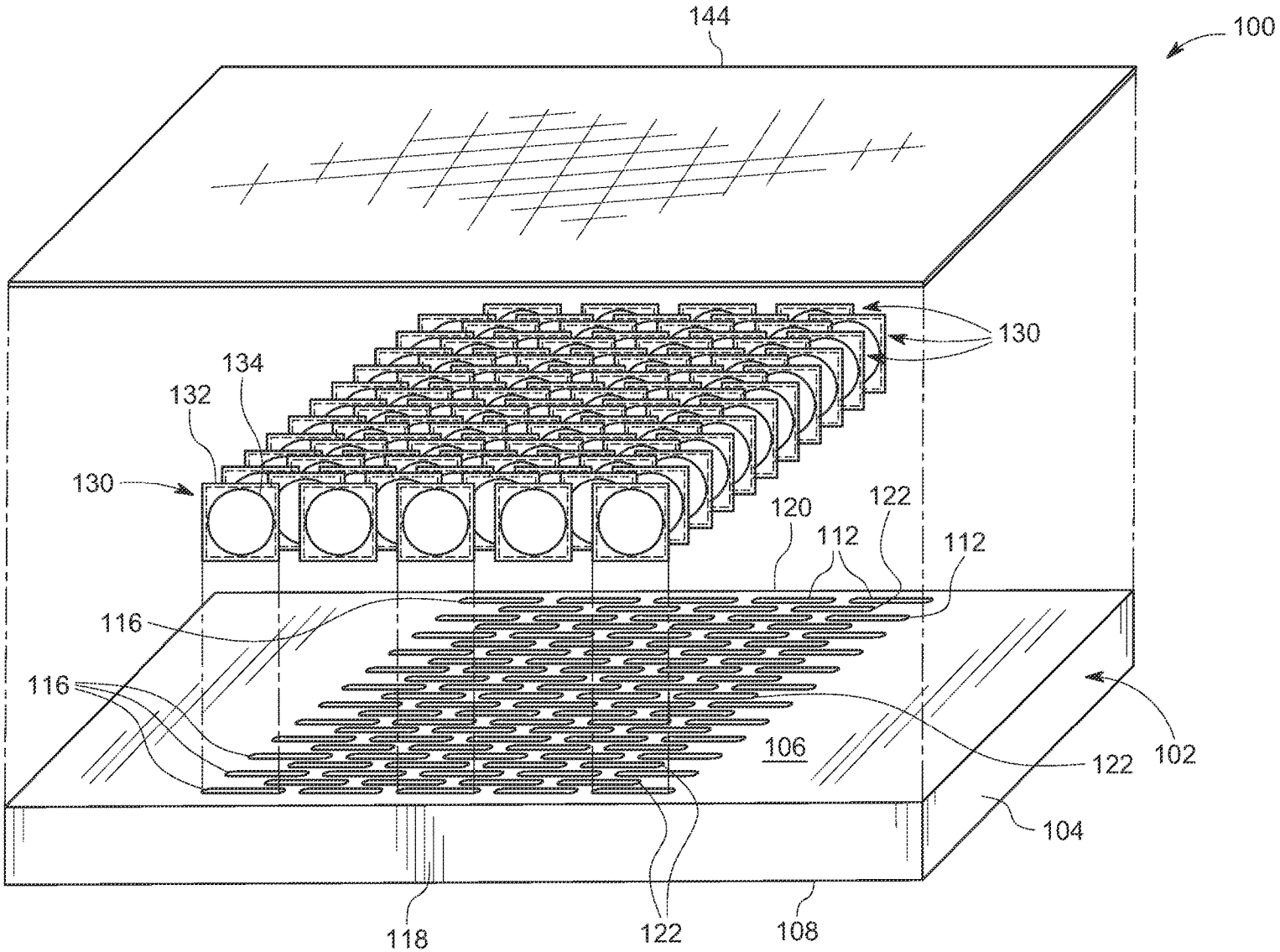
FIG. 1 illustrates an exploded view of a support structure of a mattress, in accordance with an embodiment of the disclosure.

Referring to FIG. 1, a mattress 100 including a support structure 102 (i.e., base structure 102) is shown. The support structure 102 includes a base layer 104 having a first surface 106 (i.e., upper surface 106) and a second surface 108 (i.e., lower surface 108) disposed opposite to the first surface 106 and adapted to contact a surface of a bed or a ground.

Further, the base layer 104 includes a plurality of slots 112 extending through a thickness of the base layer 104 from the first surface 106 to the second surface 108. As shown, each slot 112 includes a substantially rectangular cross-section having a length arranged substantially parallel to a length of the base layer 104, and a width substantially parallel to a width of the base layer 104. In an embodiment, the length of each slot 112 may be approximately 6 inches, while the width of each slot is ⅝ inch. However, the dimensions of the slot can vary depending on the required softness or firmness of the support structure. Further, although the slots 112 having the rectangular cross-section are contemplated, it may be appreciated that the slots 112 may include any other suitable cross-section, such as, but not limited to, an elliptical cross-section, etc.

Figure 2:
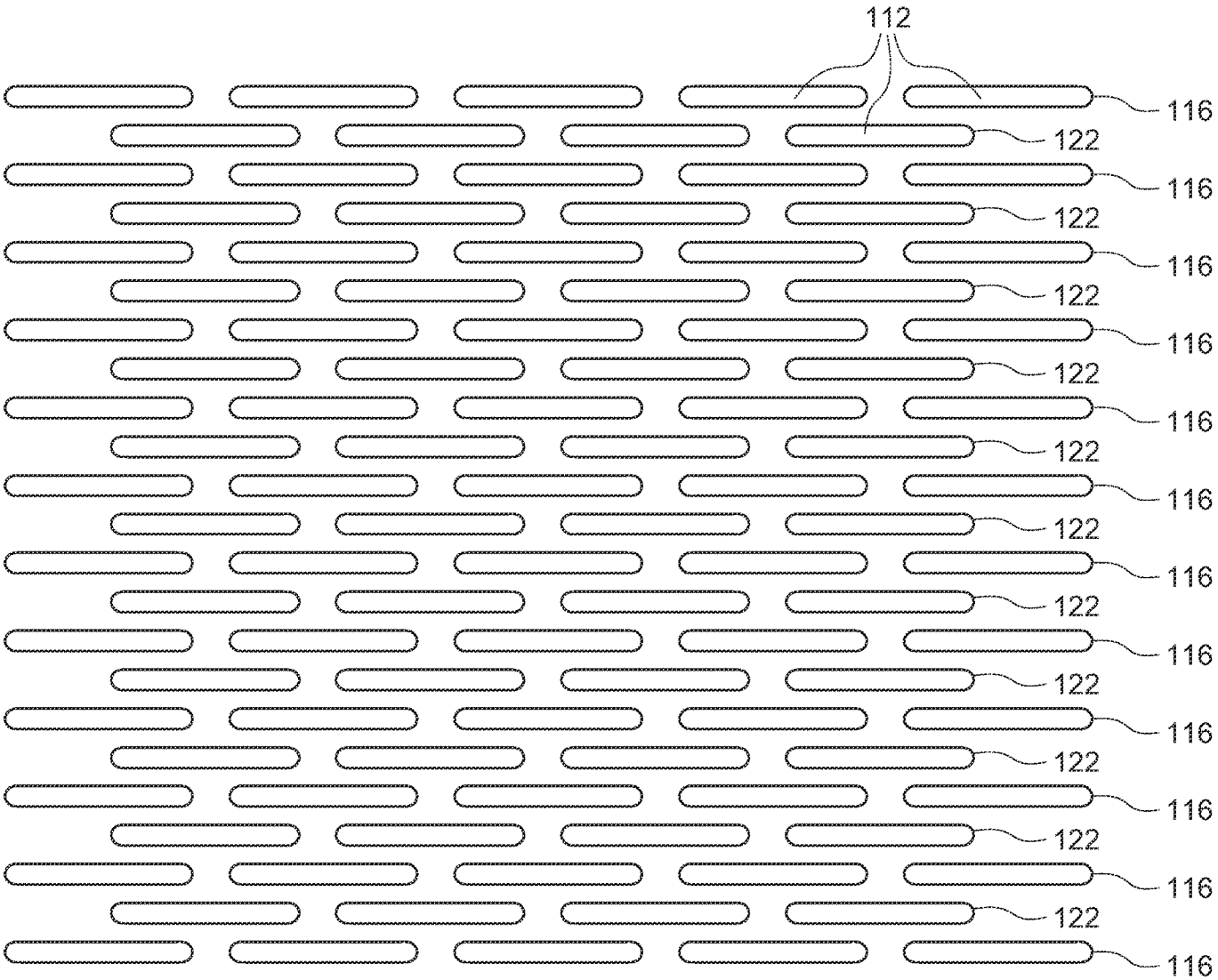
FIG. 2 illustrates an arrangement of a plurality of holes defined in a base layer of the support structure of FIG. 1, in accordance with an embodiment of the disclosure.

In certain embodiments, as shown, the slots 112 are arranged in a staggered arrangement (as shown in FIGS. 1 and 2). In such a case, the slots 112 may be arranged in a plurality of first rows 116 arrayed linearly in a lateral direction and extending from a first lateral end 118 of the base layer 104 to a second lateral end 120 of the base layer, and a plurality of second rows 122 arrayed in a lateral direction such that a single second row 122 is disposed between two consecutive/adjacent/neighboring first rows 116. As shown, each first row 116 and each second row 122 include a set of the slots 112 that are arrayed linearly along a length of the base layer 112. Further, the slots 112 of the second row 122 are offset from the slots 112 of the neighboring first rows 116 in a lateral direction, and a central axis of each slot 112 of the second row 122 is longitudinally offset from a central axis of adjacent slots 112 of the neighboring first rows 116. Further, each slot 112 of the second row 122 partially overlaps the neighboring slots 112 of the adjacent first rows 116 in the longitudinal direction. Although, the staggered arrangement of the slots 112 is shown and contemplated, it may be appreciated that the slots 112 may be arranged in an inline arrangement. In such a case, slots 112 are arranged in the plurality of first rows 116. Also, a spacing between two adjacent first rows 116 and/or two adjacent second rows 122 and/or between neighboring first row 116 and the second row 122 may be varied depending on the required firmness and/or softness of the support structure 102.

Figure 3:
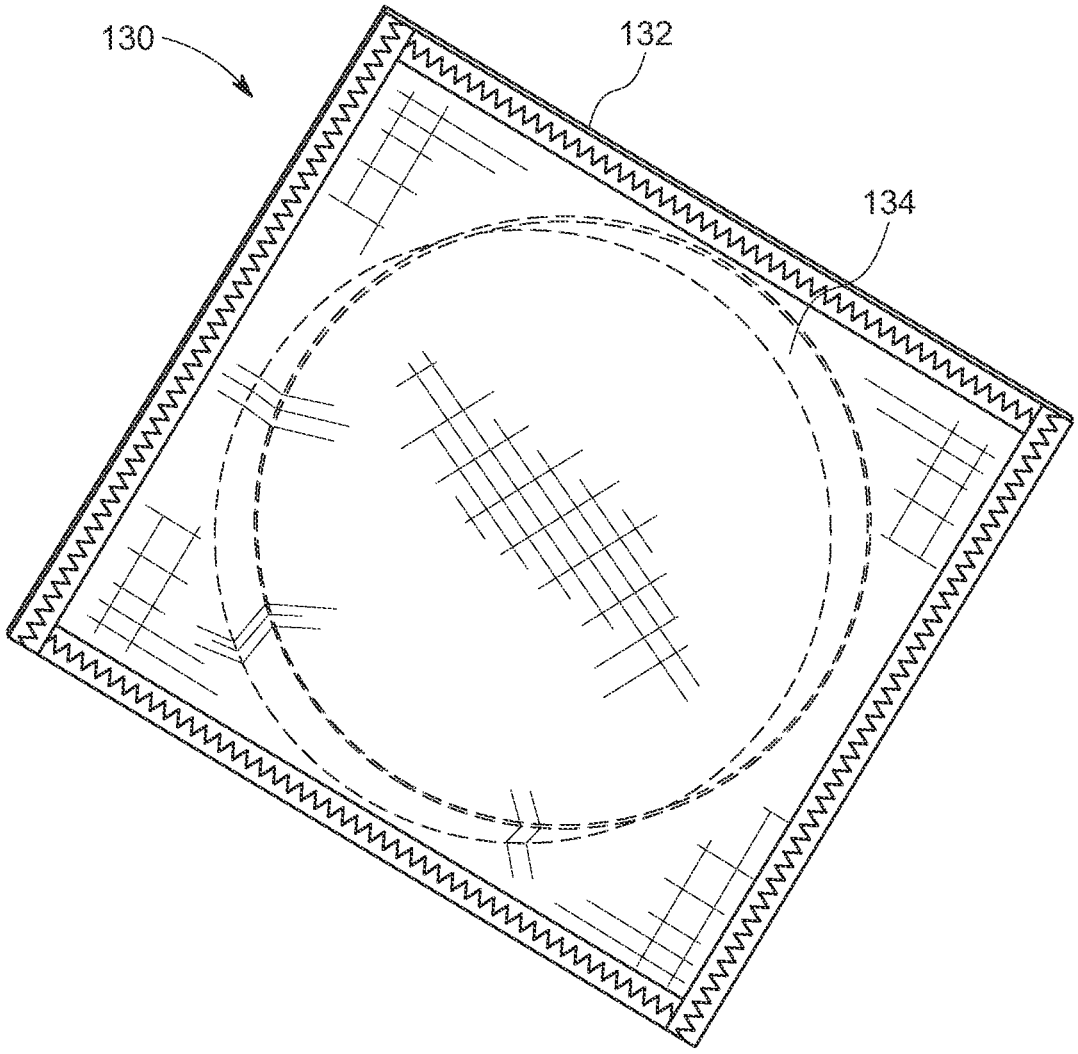
FIG. 3 illustrates a top view of a hoop assembly of the support structure of FIG. 1, in accordance with an embodiment of the disclosure.
Figure 4:
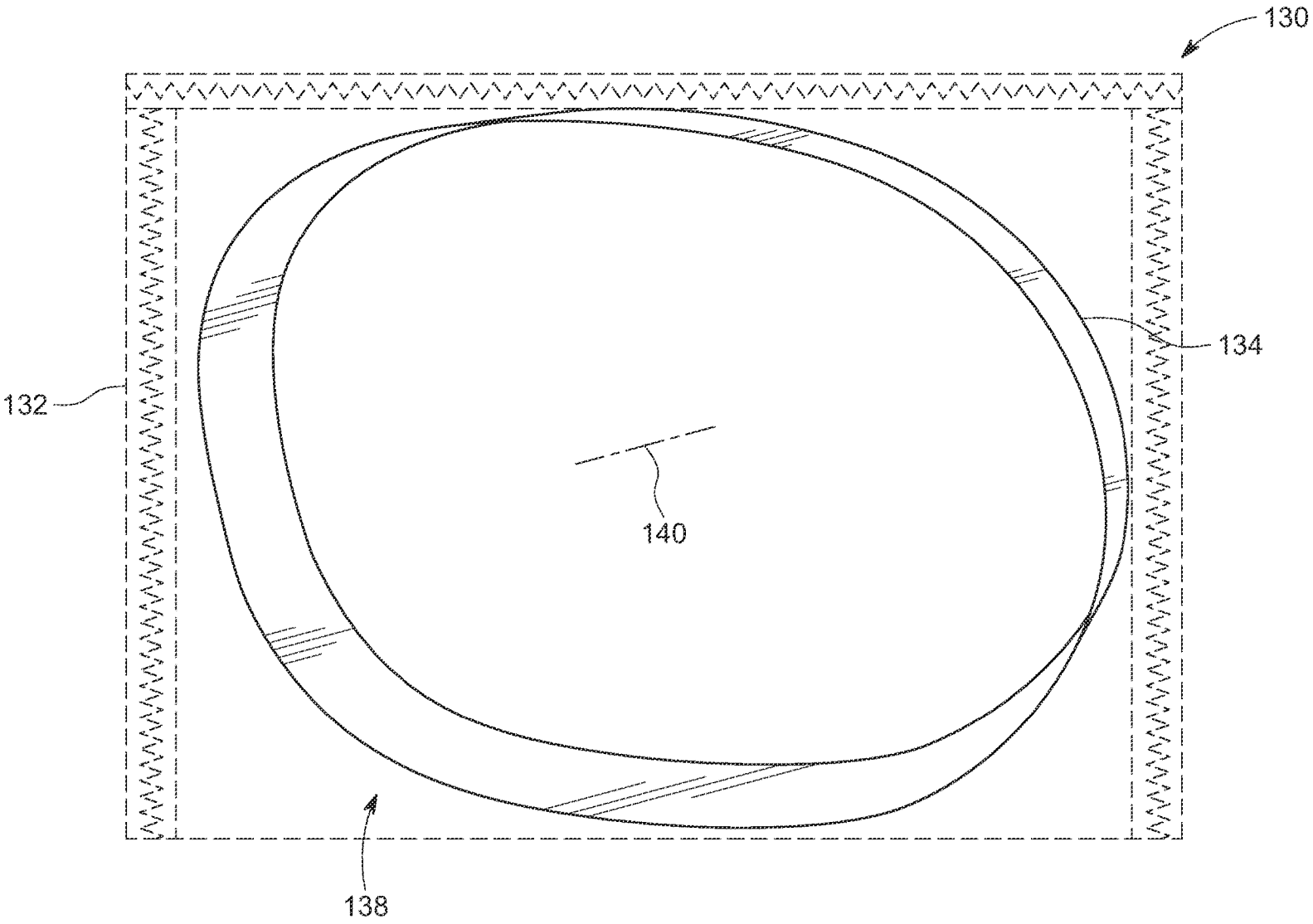
FIG. 4 illustrates a perspective view of a hoop of the hoop assembly of FIG. 3 disposed in a pouch, in accordance with an embodiment of the disclosure.

Further, the support structure 102 includes a plurality of hoop assemblies 130 disposed inside the plurality of slots 112. It may be appreciated that a structure and an arrangement of each of the plurality of hoop assemblies 130 is same, and for the sake of clarity and brevity, the structure, and the arrangement of the single hoop assembly 130 is explained. Referring to FIG. 3 and FIG. 4, the hoop assembly 130 may include a pouch 132 and a hoop 134 (also referred to as support element 134) arranged inside the pouch 132. In an embodiment, the pouch 132 may be a fabric pouch having a pocket 138 to receive the hoop 134. In certain implementation, the pocket 138 may include a square shape, while the hoop 134 includes a circular configuration having a diameter substantially equal to a length of the pocket 138. The hoop 134 may be formed by bending a thin rectangular plate into a circular shape. The hoop assembly 132 is adapted to be disposed inside the slot 112 such that hoop 134 is disposed in a vertical direction such that a central axis 140 of the hoop 134 is disposed substantially parallel to the upper surface 106 and extends along the width of the base layer 106. Accordingly, the hoop 134 may be disposed inside the slot 112 such that a horizontal diameter of the hoop 134 may extend along the length of the base layer 104 and may be substantially parallel to longitudinal edges of the base layer 104. The hoop 134 is adapted to be compressed when a person sits or lies on the mattress 100 and controls a compression of the base layer 104.

Additionally, the pouch 132 may also control a deflection of the hoop 134 under load and thereby may control the compression of the hoop 134 under load. The pouch 132 may facilitate the compression of the hoop 134 as the dimensions, i.e., the length, of the pocket 138 is substantially equal to the diameter of the hoop 134. Accordingly, the pouch 132 may facilitate in controlling a deformation or expansion of the hoop 134 under load and thereby allows a loading of a bottom portion of the hoop 134, while contouring a top portion of the hoop 134 when the person lies on the mattress 100. In an embodiment, the pouch 132 may be omitted. Moreover, the mattress 100 is shown to include a single support structure 102, it may be appreciated that the mattress 100 may more than one support structures 102. In such a case, the support structures 102 may be positioned above each other. Further, in embodiment, the support structure 102 may include a fabric layer 144 (shown in FIG. 1) and/or a foam layer disposed above the base layer 104 and contacting the base layer 104, covering the hoop assemblies 130. Similarly, the support structure 102 may include another fabric or foam layer disposed below the base layer and contacting the second surface 108 and covering the hoop assemblies 130.

Figure 5:
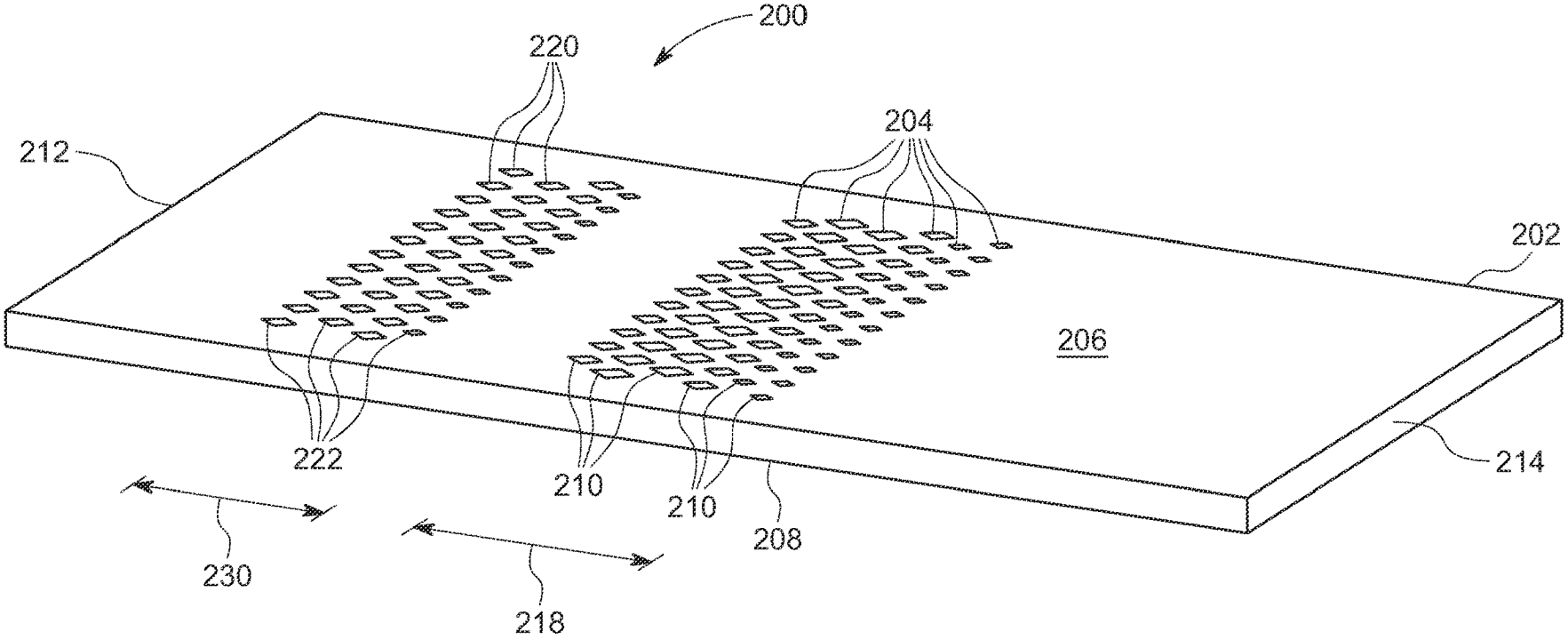
FIG. 5 illustrates a top perspective view of an alignment structure of the mattress, in accordance with an embodiment of the disclosure.

Additionally, or optionally, referring to FIG. 5, the mattress 100 may include an alignment structure 200 adapted to be disposed above the support structure 102 and abutting the support structure 102. The alignment structure 200 facilitates in ergonomically aligning the back or lumber portion of the person by providing additional cushioning to a shoulder portion and hip portion when the person lies on the mattress 100. The alignment structure 200 may include an alignment layer 202 disposed above the base layer 104. The alignment layer 202 may be made of a form material and may have a density lesser than a density of the base layer 104. Further, the alignment layer 202 may include a plurality of first cutouts 204 extending, through an entire thickness of the alignment layer 202, from a first surface 206 (i.e., top surface 206) of the alignment layer 202 to a second surface 208 (i.e., bottom surface 208) of the alignment layer 202 and arranged in a plurality of rows 210 in a staggered arrangement. In such a case, each first cutout 204 arranged in one of the rows 210 partially overlaps two first cutouts 204 arranged in adjacent row 210 and arranged vertically above and/or below the first cutout 204 of the one of the rows 210.

As shown, the first cutouts 204 are arranged between a first longitudinal end 212 and a second longitudinal end 214 such that the first cutouts 204 are disposed beneath and in proximate to a lower back and the hip portion of the person when the person lies on the mattress 100. Accordingly, a density of a portion 218 (hereinafter referred to as first portion 218) of the alignment layer 202 having the first cutouts 204 decreases relative to the neighboring areas or portions that are devoid of the first cutouts 204, such as, the areas/portions/regions of the alignment layer 202 adapted to support the lumber region of the person. Due to a decrease in the density of the first portion 218, the first portion 218 becomes softer relative to the adjacent areas/regions/portions. Accordingly, a compression of the alignment layer 202 corresponding to the first portion 218 is relatively more than a compression of the alignment layer 202 corresponding to the areas/regions/portions adjacent to the first portion 218 when a person lies on the mattress 100, resulting in proper support to the lumber region of the person. Further, the density of the foam within the first portion 218 may be varied by varying sizes of the first cutouts 204 and spacing between the rows 210. In an embodiment, each first cutout 204 may include a diamond shape. In certain implementations, walls defining the first cutout 204 may be substantially perpendicular to the top surface 206 or the bottom surface 208. In an embodiment, the walls may at an inclination relative to the top surface 208 or the bottom surface 208. Although the first cutouts 204 having the diamond shape is contemplated, it may be appreciated that the first cutouts 204 may include any other suitable shape, such as, but not limited to, a circular shape, a square shape, an elliptical shape, a rectangular shape, or any other polygonal shape known in the art. Also, in an embodiment, the plurality of first cutouts 204 may be arranged in in-line arrangement.

Similar to the plurality of the first cutouts 204, the alignment layer 202 may include a plurality of second cutouts 220 extending, through an entire thickness of the alignment layer 202, from the top surface 206 of the alignment layer 202 to the bottom surface 208 of the alignment layer 202 and arranged in a plurality of rows 222 in a staggered arrangement. In such a case, each second cutout 220 arranged in one of the rows 222 partially overlaps two second cutouts 220 arranged in adjacent row 222 and arranged vertically above and/or below the second cutout 204 of the one of the rows 222.

As shown, the second cutouts 220 are arranged between the first longitudinal end 212 and the second longitudinal end 214 such that the second cutouts 220 are disposed beneath and in proximate to an upper back and/or the shoulder portion of the person when the person lies on the mattress 100. Further, the second cutouts 220 are disposed between the first longitudinal end 212 and the first cutouts 204. Due to the presence of second cutouts 220, a density of a portion 230 (hereinafter referred to as second portion 230) having second cutouts 220 decreases relative to the areas/portions/regions disposed adjacent to the portions/regions/areas and are devoid of the second cutouts 220, such as, the area/portion/region of the alignment layer 202 adapted to support the lumber region of the person. Due to the decrease in the density of the second portion 230, the second portion 230 becomes softer relative to the adjacent areas/regions/portions. Accordingly, a compression of alignment layer 202 corresponding to the second portion 230 is relatively more than a compression of the alignment layer 202 corresponding to the portions/regions/areas neighboring the second portion 230 when a person lies on the mattress 100, resulting in proper support to the lumber region of the person.

Further, the density of the foam within the second portion 230 may be varied by varying sizes of the second cutouts 220 and/or varying the spacing between the rows 222. In an embodiment, each second cutout 220 may include a diamond shape. Also, walls defining the second cutout 220 may be substantially perpendicular to the top surface 206 or the bottom surface 208. In an embodiment, the walls may at an inclination relative to the top surface 208 or the bottom surface 208. Although the second cutouts 220 having the diamond shape is contemplated, it may be appreciated that the second cutouts 220 may include any other suitable shape, such as, but not limited to, a circular shape, a square shape, an elliptical shape, a rectangular shape, or any other polygonal shape known in the art. Also, in an embodiment, the plurality of second cutouts 204 may be arranged in in-line arrangement. Although the alignment layer 202 having the cutouts in the portion 218, 230 are shown and contemplates, it may be envisioned that the alignment layer 202 may include cutouts only in the first portion 218 or the second portion 230. Also, it may be appreciated that the any other portion of the alignment layer 202, such as, but not limited to, portions corresponding to legs of head of the person, may also define cutouts to vary a compression of the alignment layer 202 relative to adjacent portions when load is applied.

Figure 6:
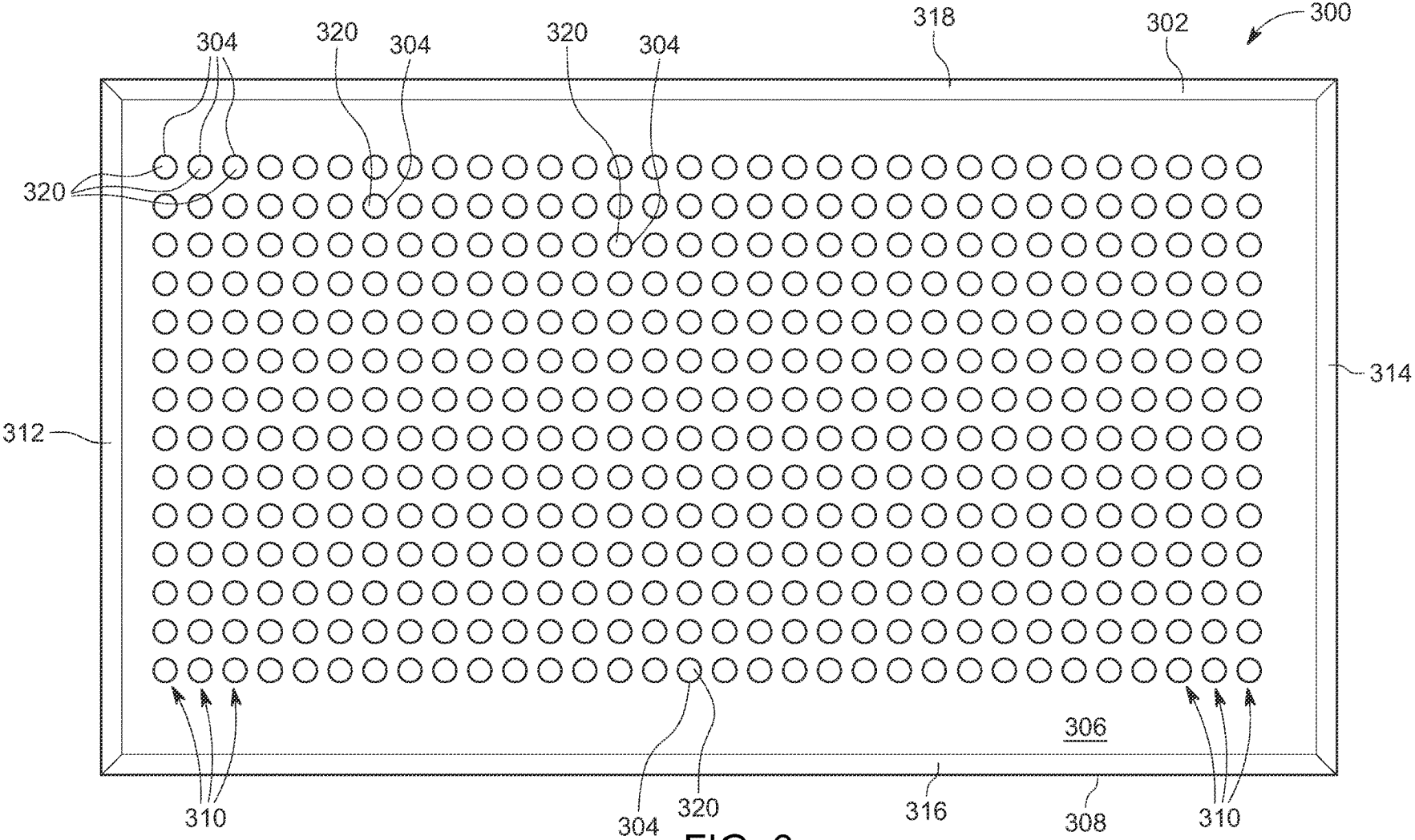
FIG. 6 illustrates a top view of a flex structure of the mattress, in accordance with an embodiment of the disclosure.
Figure 7:
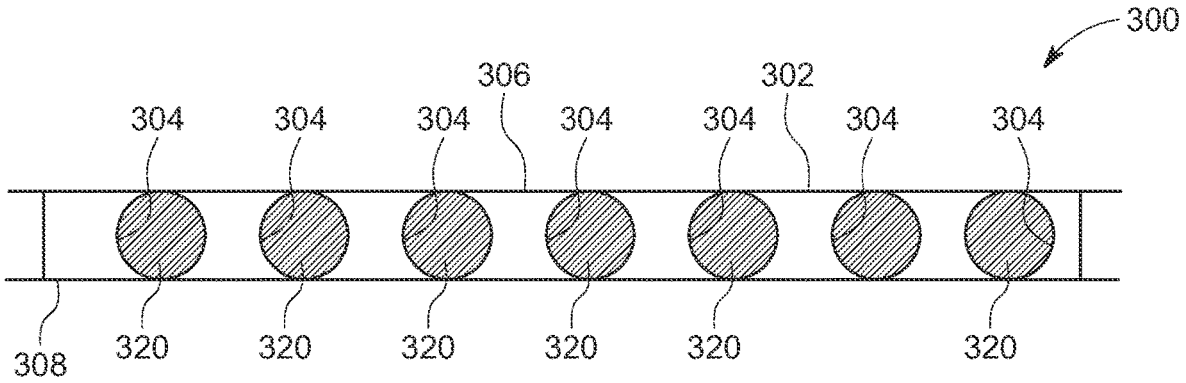
FIG. 7 illustrates a side sectional view of the flex structure of FIG. 6, in accordance with an embodiment of the disclosure.
Figure 8:
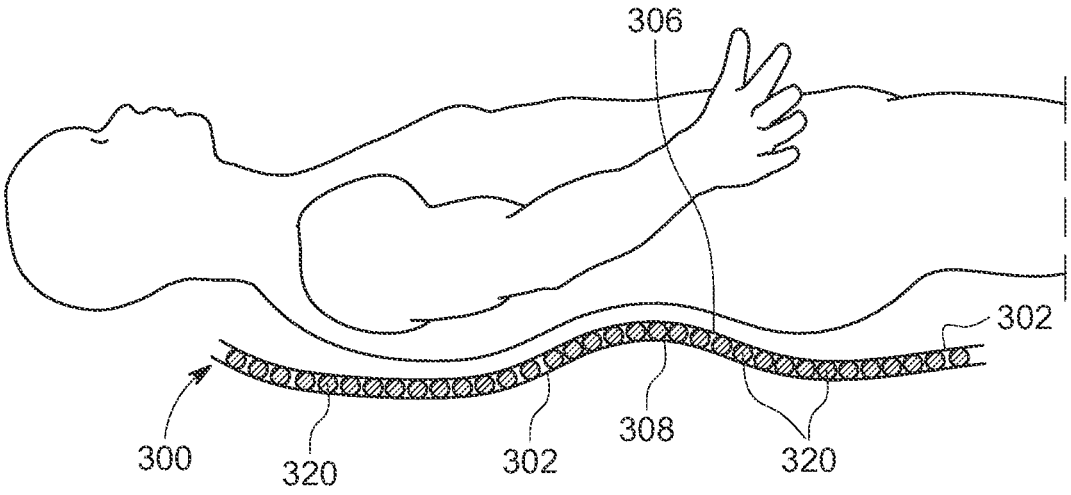
FIG. 8 illustrates a deformation of the flex structure of FIG. 6 according to a body profile of a person lying on the mattress, in accordance with an embodiment of the disclosure.

In one or more embodiments, referring to FIGS. 6, 7, and 8, the mattress 100 may include a flex structure 300 disposed above the alignment structure 200 and adapted to flex and temporarily deform according to a body profile of the person lying on the mattress 100 (as shown in FIG. 8). The flex structure 300 may include a support layer 302 defining a plurality of holes 304 extending from a first surface 306 (i.e., upper surface 306) to a second surface 308 (i.e., lower surface 308). The second surface 308 may be disposed proximate to the alignment layer 202 and may abut the alignment structure 200, while the first surface 306 may be disposed distally to the alignment layer 202. As shown, the holes 304 are arranged in a plurality of rows 310 arrayed linearly from a first longitudinal end 312 of the support layer 302 to a second longitudinal end 314 of the support layer 302. Further, the holes in each row 310 are arrayed linearly and laterally along a width of the support layer 302 and may extend from a first lateral end 316 to a second lateral end 318. Accordingly, the holes 304 are disposed in an in-line arrangement in a rectangular pattern. However, the holes 304 may be arranged in a staggered arrangement. As shown, each hole 304 may include a circular cross-section and may include a spherical shape. Although, the holes 304 having the circular cross-section are contemplated, it may be envisioned that the holes 304 may include other suitable cross-sections, such as, but not limited to, an elliptical cross-section, a square cross-section, a rectangular cross-section, etc.

Moreover, the flex structure 300 may include a plurality of marbles 320 arranged in the plurality of holes 304. The marble 320 is arranged in the hole 304 such that the marble 320 forms an interference fit within the hole 304, and no portion of the marble 304 may extend outside the hole 304 beyond the first surface 306 and the second surface 308. For example, in an embodiment, the marble 320 may be a spherical marble 322. In such a case, a diameter of the marble 320 may be equal to or less than a depth of the hole 304. Therefore, an outer surface of the marble 320 may remain flush with the first surface 306 and/or the second surface 308. Although, marble 320 having a spherical shape is contemplated, it may be appreciated that the marble 320 may include any other suitable shape, such as, but not limited to, an elliptical shape, a tear drop shape, or any other suitable that avoids tearing of the support layer 302 when disposed inside the hole 304. The marbles 320 inside the holes 304 prevents/restricts a compression of the support layer 302, while facilitating a flexing or deformation of the support layer 302 in accordance to the body profile of the person lying on the mattress 100. In this manner, the flex structure 300 provides firmness to the mattress 100.

Figure 9:
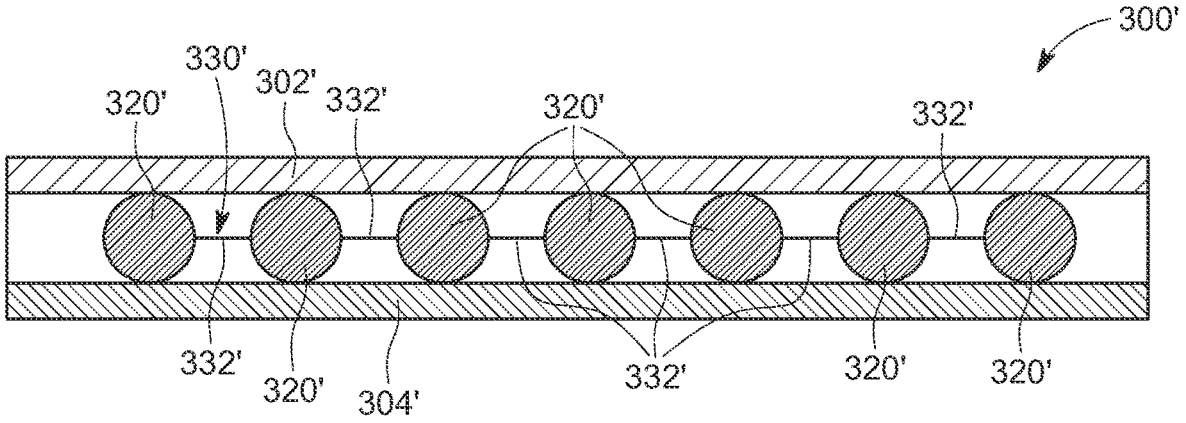
FIG. 9 illustrates a side sectional view of a flex structure, in accordance with an embodiment of the disclosure.
Figure 10:
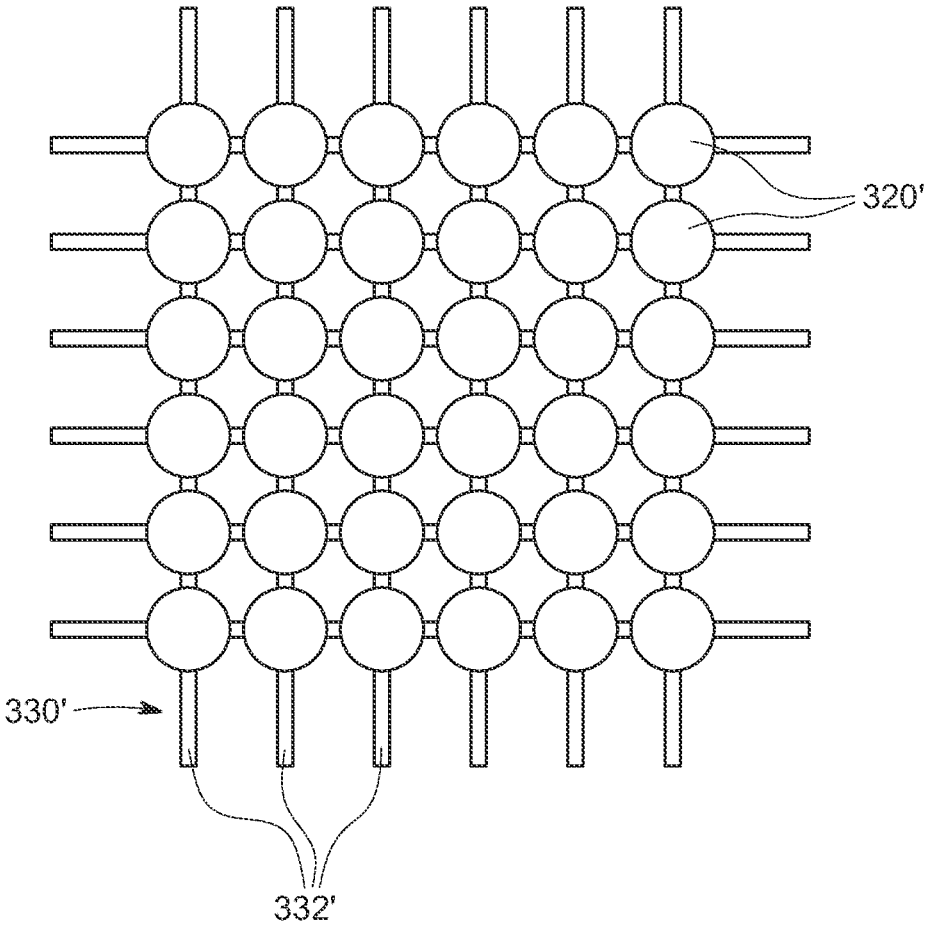
FIG. 10 illustrates a connecting grid and a plurality of marbles attached to the connecting grid of the flex structure of FIG. 9, in accordance with an embodiment of the disclosure.

Referring to FIGS. 9 and 10, a flex structure 300' according to an alternative embodiment of the disclosure. The flex structure 300' includes a first support layer 302' and a second support layer 304' arranged opposite and substantially parallel to each other and may be made of foam. Further, the flex structure includes a plurality of marbles 320' sandwiched or arranged between the first support layer 302' and the second support layer 304', and engaged with the support layers 302', 304'. The plurality of marbles 320' is identical to the plurality of marbles 320, and is arranged in grid pattern in a plurality of rows. The flex structure 300' further includes a connecting grid 330' having plurality of grid elements 332' connecting each marble 320' with adjacently arranged marbles 320'. The connecting elements 330' together form a mesh structure, and a single marble 320' is arranged at an intersection of two grid elements 332'. The marbles 320' prevents/restricts a compression of the support layers 302', 304' while facilitating a flexing or deformation of the support layers 302', 304' in accordance with the body profile of the person lying on the mattress 100. In this manner, the flex structure 300' provides firmness to the mattress 100. In an embodiment, the connecting element 332' may be either flexible filaments or inflexible filaments.

Additionally, the marbles 320, 320' may be made from glass, metal, plastic, composites, including wood or other cellulose materials. Further, the marbles 320, 302' may be of different sizes, densities, or compressibility.

Although the mattress 100 having the support structure 102, the flex structure 300, 300', and the alignment structure 200 disposed/sandwiched between the support structure 102 and the flex structure 300, 300' is disclosed, it may be envisioned that the alignment structure 200 and/or the flex structure 300, 300' may be omitted. In such a case, the mattress 100 may include the support structure 102 and the alignment structure 200, the support structure 102 and the flex structure 300, 300' or only the support structure 102. In some embodiments, the mattress 100 may include only the alignment structure 200. In some other embodiment, the mattress 100 may include the flex structure 300, 300' only.

It should be understood that the foregoing description is only illustrative of the aspects of the disclosed embodiments. Various alternatives and modifications can be devised by those skilled in the art without departing from the aspects of the disclosed embodiments. Accordingly, the aspects of the disclosed embodiments are intended to embrace all such alternatives, modifications, and variances that fall within the scope of the appended claims. Further, the mere fact that different features are recited in mutually different dependent or independent claims does not indicate that a combination of these features cannot be advantageously used, such as a combination remaining within the scope of the aspects of the disclosed embodiments.

What is claimed is:

1. A mattress, comprising:

a support structure having a base layer having a first surface and a second surface arranged opposite to the first surface, the base layer defining a plurality of slots extending from the first surface to the second surface and arranged in a plurality of rows in a staggered arrangement, and a plurality of hoop assemblies arranged inside the plurality of the slots, each hoop assembly includes a hoop arranged vertically inside the slot and a central axis of the hoop extends substantially horizontally and parallel to the first surface, wherein the hoop is configured to compress under a load; and a flex structure supported on the support structure and including at least one support layer, a plurality of marbles engaged with the at least one support layer and supported by the at least one support layer, wherein the plurality of marbles is arranged in a grid pattern along the at least one support layer.

2. The mattress of claim 1, wherein the plurality of the rows is arrayed in a lateral direction between a first lateral end of the base layer and a second lateral end of the base layer, and the slots are arrayed in a longitudinal direction within each row.

3. The mattress of claim 2, wherein the plurality of rows includes a plurality of first rows and a plurality of second rows, where a single second row is arranged between two neighboring first rows, wherein each slot of the second row overlaps two slots of the adjacent first row.

4. The mattress of claim 1, wherein each hoop assembly includes a pouch defining a pocket, wherein the hoop is arranged inside the pocket and the pouch controls a deflection of hoop under the load.

5. The mattress of claim 4, wherein the pouch allows a loading of a portion of the hoop arranged proximate to the second surface of the base layer and contouring a portion of the hoop arranged proximate to the first surface of the base layer when a person lies on the mattress.

6. The mattress of claim 1, wherein the support structure includes a fabric layer arranged on the base layer and abutting the first surface of the base layer to cover the plurality of hoop assemblies.

7. The mattress of claim 1 further including an alignment layer sandwiched between the support structure and the flex structure to facilitate an ergonomic alignment of a back or a lumber portion of a person when a person lies on the mattress.

8. The mattress of claim 7, wherein the alignment layer includes a first surface and a second surface arranged opposite to the first surface and disposed facing the first surface of the base layer, the alignment layer defines a plurality of first cut-outs extending from the first surface to the second surface and arranged in a plurality of rows in a staggered arrangement.

9. The mattress of claim 8, wherein the first cutouts are arranged between a first longitudinal end of the alignment layer and a second longitudinal end of the alignment layer such that the first cut-outs are arranged, at least partially, beneath a lower back and a hip portion of a person when the person lies on the mattress.

10. The mattress of claim 8, wherein each first cutout includes a diamond shape.

11. The mattress of claim 7, wherein the alignment layer includes a plurality of second cutouts extending from a first surface of the alignment layer to a second surface of the alignment layer, wherein the plurality of second cutouts is arranged in a plurality of rows in a staggered arrangement.

12. The mattress of claim 11, wherein the second cut-outs are arranged between a first longitudinal end of the alignment layer and a second longitudinal end of the alignment layer such that the second cutouts are arranged, at least partially, beneath at least one of an upper back or a shoulder portion of the person when the person lies on the mattress.

13. The mattress of claim 11, wherein each second cutout includes a diamond shape.

14. The mattress of claim 7, wherein a density of the alignment layer is less than a density of the base layer.

15. The mattress of claim 1, wherein the support layer includes a first surface and a second surface arranged opposite to the first surface and defines a plurality of holes extending from the first surface to the second surface and arranged in a plurality of rows, and the plurality of marbles is arranged in the plurality of holes.

16. The mattress of claim 15, wherein each marble is a spherical marble and a diameter of each marble is equal to or less than a depth of the associated hole.

17. The mattress of claim 1, wherein the at least one support layer includes a first support layer and a second support layer arranged spaced apart and opposite to the first support layer, wherein the plurality of marbles is arranged between the first support layer and the second support layer.

18. The mattress of claim 17, wherein the flex structure includes a connecting grid having a plurality of connecting elements connecting each marble with adjacently disposed marbles.

* * * * *